US011794305B2

(12) United States Patent
Lee et al.

(10) Patent No.: US 11,794,305 B2
(45) Date of Patent: Oct. 24, 2023

(54) PLATEN SURFACE MODIFICATION AND HIGH-PERFORMANCE PAD CONDITIONING TO IMPROVE CMP PERFORMANCE

(71) Applicant: Applied Materials, Inc., Santa Clara, CA (US)

(72) Inventors: Christopher Heung-Gyun Lee, San Jose, CA (US); Anand Nilakantan Iyer, Cupertino, CA (US); Hyuen Karen Tran, San Jose, CA (US); Ghunbong Cheung, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 513 days.

(21) Appl. No.: 17/035,504

(22) Filed: Sep. 28, 2020

(65) Prior Publication Data

US 2022/0097206 A1 Mar. 31, 2022

(51) Int. Cl.

| | |
|---|---|
| ***B24B 53/00*** | (2006.01) |
| ***B24B 37/16*** | (2012.01) |
| ***B24B 29/04*** | (2006.01) |

(52) U.S. Cl.

CPC ..... *B24B 53/005* (2013.01); *B24B 29/04* (2013.01); *B24B 37/16* (2013.01)

(58) Field of Classification Search

CPC ..... B24B 7/228; B24B 7/241; B24B 37/005; B24B 37/042; B24B 37/102; B24B 37/12;

(Continued)

(56) References Cited

U.S. PATENT DOCUMENTS 5,558,563 A * 9/1996 Cote ..... B24B 37/26 451/527

5,836,805 A 11/1998 Obeng (Continued)

FOREIGN PATENT DOCUMENTS

CN 1979359 A 6/2007
JP 2007266547 A 10/2007

(Continued)

OTHER PUBLICATIONS

Satake, JP-2011031322-A machine translation, Jul. 30, 2009 (Year: 2009).*

(Continued)

*Primary Examiner* — Brian D Keller
*Assistant Examiner* — Marcel T Dion
(74) *Attorney, Agent, or Firm* — Patterson + Sheridan, LLP

(57) ABSTRACT

Embodiments herein generally relate to chemical mechanical polishing (CMP) systems and methods for reducing non-uniform material removal rate at or near the peripheral edge of a substrate when compared to radially inward regions therefrom. In one embodiment, a polishing system includes a substrate carrier comprising an annular retaining ring which is used to surround a to-be-processed substrate during a polishing process and a polishing platen. The polishing platen includes cylindrical metal body having a pad-mounting surface. The pad-mounting surface comprises a plurality of polishing zones which include a first zone having a circular or annular shape, a second zone circumscribing the first zone, and a third zone circumscribing the second zone. A surface of the second zone is recessed from surfaces of the first and third zones adjacent thereto, and a width of the second zone is less than an outer diameter of the annular retaining ring.

17 Claims, 5 Drawing Sheets

(58) Field of Classification Search
CPC ..... B24B 37/16; B24B 37/26; B24B 37/32; B24B 37/20; B24B 49/18; B24B 53/017; B24B 53/005
USPC ..... 451/41, 56, 286, 287, 443
See application file for complete search history.

(56) References Cited

U.S. PATENT DOCUMENTS

| | | | | |
|---|---|---|---|---|
| 5,974,679 | A | 11/1999 | Birang et al. | |
| 6,036,586 | A | 3/2000 | Ward | |
| 6,040,244 | A | 3/2000 | Arai et al. | |
| 6,045,434 | A | 4/2000 | Fisher, Jr. et al. | |
| 6,186,864 | B1 | 2/2001 | Fisher, Jr. et al. | |
| 6,220,942 | B1 | 4/2001 | Tolles et al. | |
| 6,299,519 | B1 | 10/2001 | Easter et al. | |
| 6,376,378 | B1 * | 4/2002 | Chen | B24B 37/20 438/692 |
| 6,488,573 | B1 | 12/2002 | Kobayashi et al. | |
| 6,616,513 | B1 | 9/2003 | Osterheld | |
| 6,661,224 | B1 | 12/2003 | Linder | |
| 6,773,332 | B2 | 8/2004 | Moore | |
| 6,835,116 | B2 | 12/2004 | Oguri et al. | |
| 6,872,132 | B2 | 3/2005 | Elledge et al. | |
| 6,966,816 | B2 | 11/2005 | Swedek et al. | |
| 7,018,269 | B2 | 3/2006 | Anderson | |
| 7,024,268 | B1 | 4/2006 | Bennett et al. | |
| 7,040,956 | B2 | 5/2006 | Paik | |
| 7,070,479 | B2 | 7/2006 | Faustmann et al. | |
| 7,097,535 | B2 | 8/2006 | Glashauser et al. | |
| 7,128,803 | B2 | 10/2006 | Owczarz et al. | |
| 7,134,947 | B2 | 11/2006 | Stark et al. | |
| 7,153,185 | B1 | 12/2006 | Birang et al. | |
| 7,156,722 | B2 | 1/2007 | Min et al. | |
| 7,163,439 | B2 | 1/2007 | Chandrasekaran | |
| 7,189,140 | B1 | 3/2007 | Shugrue et al. | |
| 7,195,536 | B2 | 3/2007 | Swedek et al. | |
| 7,198,546 | B2 | 4/2007 | Berman et al. | |
| 7,220,163 | B2 | 5/2007 | Shin | |
| 7,247,080 | B1 | 7/2007 | Bennett et al. | |
| 7,258,600 | B1 | 8/2007 | Benner | |
| 7,306,506 | B2 | 12/2007 | Elledge | |
| 7,314,401 | B2 | 1/2008 | Chandrasekaran | |
| 7,413,986 | B2 | 8/2008 | Paik | |
| 7,452,264 | B2 | 11/2008 | Mavliev et al. | |
| 7,585,425 | B2 | 9/2009 | Ward | |
| 7,840,305 | B2 | 11/2010 | Behr et al. | |
| 7,963,826 | B2 | 6/2011 | Nangoy et al. | |
| 8,043,870 | B2 | 10/2011 | Manens et al. | |
| 8,078,419 | B2 | 12/2011 | Kobayashi et al. | |
| 8,182,709 | B2 | 5/2012 | Heinrich et al. | |
| 8,337,279 | B2 | 12/2012 | Dhandapani et al. | |
| 9,138,860 | B2 | 9/2015 | Dhandapani et al. | |
| 9,156,130 | B2 | 10/2015 | Shimano et al. | |
| 9,308,618 | B2 | 4/2016 | Benvegnu | |
| 10,525,566 | B2 | 1/2020 | Hong et al. | |
| 10,562,147 | B2 | 2/2020 | Butterfield et al. | |
| 11,222,786 | B2 * | 1/2022 | Shin | H01L 22/12 |
| 2002/0106971 | A1 | 8/2002 | Rodriquez et al. | |
| 2003/0060127 | A1 | 3/2003 | Kaushal et al. | |
| 2003/0186627 | A1 | 10/2003 | So | |
| 2004/0053566 | A1 | 3/2004 | Tolles et al. | |
| 2004/0259477 | A1 | 12/2004 | Anderson | |
| 2005/0095963 | A1 * | 5/2005 | Stark | B24B 37/16 451/259 |
| 2005/0142987 | A1 | 6/2005 | Kramer et al. | |
| 2005/0173259 | A1 | 8/2005 | Mavliev et al. | |
| 2005/0186892 | A1 * | 8/2005 | Chen | B24B 37/16 451/285 |
| 2006/0196283 | A1 | 9/2006 | Yang et al. | |
| 2006/0226123 | A1 | 10/2006 | Birang | |
| 2007/0298692 | A1 | 12/2007 | Mavliev et al. | |
| 2008/0014845 | A1 | 1/2008 | Yilmaz et al. | |
| 2009/0137190 | A1 | 5/2009 | Togawa et al. | |
| 2009/0191797 | A1 | 7/2009 | Nabeya et al. | |
| 2009/0247057 | A1 | 10/2009 | Kobayashi et al. | |
| 2009/0280580 | A1 | 11/2009 | Manens et al. | |
| 2009/0280850 | A1 | 11/2009 | Mathur et al. | |
| 2009/0318060 | A1 | 12/2009 | Dhandapani et al. | |
| 2011/0006761 | A1 | 1/2011 | Redko et al. | |
| 2011/0189856 | A1 | 8/2011 | Xu et al. | |
| 2012/0270477 | A1 * | 10/2012 | Nangoy | B24B 53/017 451/443 |
| 2013/0017762 | A1 | 1/2013 | Thaldorf et al. | |
| 2013/0122783 | A1 | 5/2013 | Menk et al. | |
| 2013/0165023 | A1 | 6/2013 | Sung | |
| 2015/0140900 | A1 | 5/2015 | Lee et al. | |
| 2016/0271749 | A1 | 9/2016 | Shinozaki | |
| 2018/0056476 | A1 | 3/2018 | Zhang et al. | |
| 2019/0143475 | A1 | 5/2019 | Dhandapani et al. | |
| 2019/0283208 | A1 | 9/2019 | Dhandapani et al. | |
| 2020/0164486 | A1 * | 5/2020 | Che | H01L 21/67253 |
| 2020/0282509 | A1 * | 9/2020 | Zhang | H01L 21/3212 |
| 2021/0053180 | A1 * | 2/2021 | Yen | B24B 37/24 |

FOREIGN PATENT DOCUMENTS

| | | | | |
|---|---|---|---|---|
| JP | 2009079984 | A | | 4/2009 |
| JP | 2011031322 | A | * | 2/2011 |
| JP | 2011031322 | A | | 2/2011 |
| JP | 2013010169 | A | | 1/2013 |
| KR | 1020170022583 | A | | 3/2017 |
| KR | 1020200062421 | A | | 6/2020 |

OTHER PUBLICATIONS

International Search Report/ Written Opinion issued to PCT/US2021/048033 dated Dec. 10, 2021.

Kakireddy, Raghava, et al.—"High Performance Pad Conditioning (HPPC) Arm for Advanced Pad Conditioning" presentation, https://nccavs-usergroups.avs.org/wp-content/uploads/CMPUG2017/CMP417-7-Kakireddy-AMAT.pdf, last visited Sep. 28, 2020, 10 pages.

Wei, Xiaomin, et al.—"Effect of Retaining Ring Slot Design on Slurry Film Thickness during CMP", Electrochemical and Solid-State Letters, 13 (4) H119-H121 (2010), 3 pages.

Kwon, Tae-Young, et al.—"Scratch formation and its mechanism in chemical mechanical planarization (CMP)", publication, Department of Materials Engineering, Hanyang University, Ansan 426-791, Korea, Jun. 14, 2013, pp. 280-305, 27 pages.

Wu, Changhong, et al.—"Lubrication in Chemical and Mechanical Planarization", publication, Intechopen.com, Oct. 26, 2016, pp. 255-267.

Philipossian, Ara, et al.—"Chemical Mechanical Planarization and Old Italian Violins" publication, Micromachines 2019, 9, 37, 12 pages.

Gu, Xun, et al.—"Qualification of Dynamic Pressure Distribution on Wafer by Pressure Sensing Sheet during Polishing", publication, International Conference on Planarization/CMP Technology, Nov. 19-21, 2009, Fukuoka, 7 pages.

Lee, Changsuk, et al.—"Analysis of Wafer Edge Pressure Distribution using Intelligent Pad in Chemical Mechanical Polishing", publication, International Conference on Planarization/CMP Technology, Nov. 19-21, 2014, Kobe, 4 pages.

Kim, Bum Jick, et al., "Polishing Platens and Polishing Platen Manufacturing Methods", U.S. Appl. No. 16/884,888, filed May 27, 2020, 40 pages.

* cited by examiner

PLATEN SURFACE MODIFICATION AND HIGH-PERFORMANCE PAD CONDITIONING TO IMPROVE CMP PERFORMANCE

BACKGROUND

Field

Embodiments described herein generally relate to semiconductor device manufacturing, and more particularly, to chemical mechanical polishing (CMP) systems used in semiconductor device manufacturing and substrate processing methods related thereto.

Description of the Related Art

Chemical mechanical polishing (CMP) is commonly used in the manufacturing of high-density integrated circuits to planarize or polish a layer of material deposited on a substrate. One common application of a CMP process in semiconductor device manufacturing is planarization of a bulk film, for example pre-metal dielectric (PMD) or interlayer dielectric (ILD) polishing, where underlying two or three-dimensional features create recesses and protrusions in the surface of the to be planarized material surface. Other common applications include shallow trench isolation (STI) and interlayer metal interconnect formation, where the CMP process is used to remove the via, contact or trench fill material (overburden) from the exposed surface (field) of the layer of material having the STI or metal interconnect features disposed therein.

In a typical CMP process, a polishing pad is mounted to a rotatable polishing platen. A material surface of a substrate is urged against the polishing pad in the presence of a polishing fluid. Typically, the polishing fluid is an aqueous solution of one or more chemically active components and abrasive particles suspended in the aqueous solution, e.g., a CMP slurry. The material surface of the substrate is urged against the polishing pad using a substrate carrier. A typical substrate carrier includes a membrane, bladder, or a backing plate disposed against a backside surface of the substrate and an annular retaining ring circumscribing the substrate. The membrane, bladder, or backing plate is used to apply a downforce against the substrate while the substrate carrier rotates about a carrier axis. The retaining ring surrounds the substrate as the substrate is urged against the polishing pad and is used to prevent the substrate from slipping from the substrate carrier. Material is removed across the surface of the substrate in contact with the polishing pad through a combination of chemical and mechanical activity which is provided by the polishing fluid, the relative motion of the substrate and the polishing pad, and the downforce exerted on the substrate against the polishing pad.

Generally, CMP process performance is characterized with reference to a material removal rate from the surface of the substrate and the uniformity of the material removal rate (removal rate uniformity) across the surface of the substrate. In a dielectric bulk film planarization process, non-uniform material removal rate across the surface of the substrate can lead to poor planarity and/or undesirable thickness variation of the dielectric material remaining post CMP. In a metal interconnect CMP application, metal loss resulting from poor local planarization and/or non-uniform material removal rate can cause undesirable variation in the effective resistance of the metal features, thus affecting device performance and reliability. Thus, non-uniform material removal rate across the surface of a substrate can adversely affect device performance and/or cause device failure which results in suppressed yield of usable devices formed on the substrate.

Often, non-uniform material removal rate is more pronounced in surface regions that are proximate to the peripheral edge of the substrate, e.g., within 6 mm of the peripheral edge of a 300 mm diameter substrate, when compared to the average of material removal rates calculated for locations disposed radially inward from the peripheral edge. Non-uniform material removal rates at the substrate edge is believed, at least in part, to be caused by a combination of a polishing pad "rebound" effect and non-uniform fluid distribution across the substrate between the leading edge and the trailing edge of the polishing interface. The polishing pad rebound effect is believed to be caused, at least in part, by the higher downforce used to exert the retaining ring against the polishing pad than the downforce used to urge the material surface of the substrate against the polishing pad which causes a higher contact pressure at the interface of the polishing pad and the substrate edge. Non-uniform fluid distribution is also believed to be caused, at least in part, by the interaction between the retaining ring and the polishing pad to create an uneven fluid thickness between the leading edge and the trailing edge of the polishing interface. Earlier and ongoing solutions to the problems described above have focused on ever more complicated substrate carrier and retaining ring designs. Unfortunately, such substrate carriers and/or retaining ring designs can be undesirably expensive and complex.

Accordingly, what is need in the art are solutions to the problems described above.

SUMMARY

Embodiments herein generally relate to chemical mechanical polishing (CMP) systems and methods for reducing non-uniform material removal rate at or near the peripheral edge of a substrate when compared to radially inward regions therefrom.

In one embodiment, a polishing system includes a substrate carrier comprising an annular retaining ring which is used to surround a to-be-processed substrate during a polishing process and a polishing platen. The polishing platen includes cylindrical metal body having a pad-mounting surface. The pad-mounting surface comprises a plurality of polishing zones which include a first zone having a circular or annular shape, a second zone circumscribing the first zone, and a third zone circumscribing the second zone. Here, at least portions of the pad-mounting surfaces in the first and third zones define a plane, the plane is orthogonal to a rotational axis of the polishing platen, the pad-mounting surface in the second zone is recessed from the plane, and a width of the second zone is less than an outer diameter of the annular retaining ring.

In another embodiment, a method of polishing a substrate includes urging a substrate against a surface of a polishing pad where the polishing pad is disposed on a pad-mounting surface of a polishing platen. The pad-mounting surface includes a plurality of polishing zones comprising a first zone having a circular or annular shape, a second zone circumscribing the first zone, and a third zone circumscribing the second zone. Here, at least portions of the pad-mounting surfaces in the first and third zones define a plane, the plane is orthogonal to a rotational axis of the polishing platen, and the pad-mounting surface in the second zone is recessed from the plane.

In another embodiment, a polishing platen includes a cylindrical metal body having a pad-mounting surface. The pad-mounting surface comprises a plurality of polishing zones which include a first zone having a circular or annular shape, a second zone circumscribing the first zone, and a third zone circumscribing the second zone. Here, at least portions of the pad-mounting surfaces of the first and third zones define a plane, the plane is orthogonal to a rotational axis of the polishing platen, the pad-mounting surface in the second zone is recessed from the plane, and a width of the second zone is less than an outer diameter of the annular retaining ring.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the Figures. It is contemplated that elements disclosed in one embodiment may be beneficially utilized on other embodiments without specific recitation.

DETAILED DESCRIPTION

Embodiments of the present disclosure generally relate to chemical mechanical polishing (CMP) systems, and more particularly, to polishing platens and methods for reducing non-uniform material removal rate at or near the peripheral edge of a substrate when compared to radially inward regions therefrom. Typically, depending on the type of CMP process, the material removal rate proximate to the peripheral edge of the substrate may be less than or greater than the average of material removal rates for locations disposed radially inward from the edge. The resulting non-uniform removal rate at the substrate edge is often respectively characterized as "slow edge" or "fast edge" material removal rate profile. Slow edge and fast edge material removal rate profiles are believed to be caused, at least in part, by a combined polishing pad "rebound" effect at the substrate edge and an unequal polishing fluid distribution at a polishing interface of the material surface of a substrate and the polishing pad. An example of a fast edge material removal rate profile 50 is schematically illustrated in FIG. 1B where a difference between a relatively faster material removal rate at a first radial location proximate to the substrate edge and a slower material removal rate at locations radially inward from the substrate edge is shown as Δ RR.

Figure 1A:
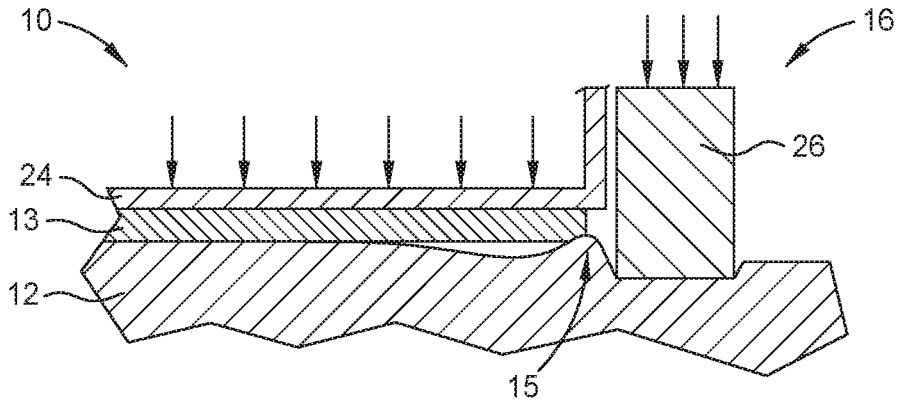
FIG. 1A schematically illustrates a non-uniform material removal rate across a radius of a substrate.
Figure 1B:
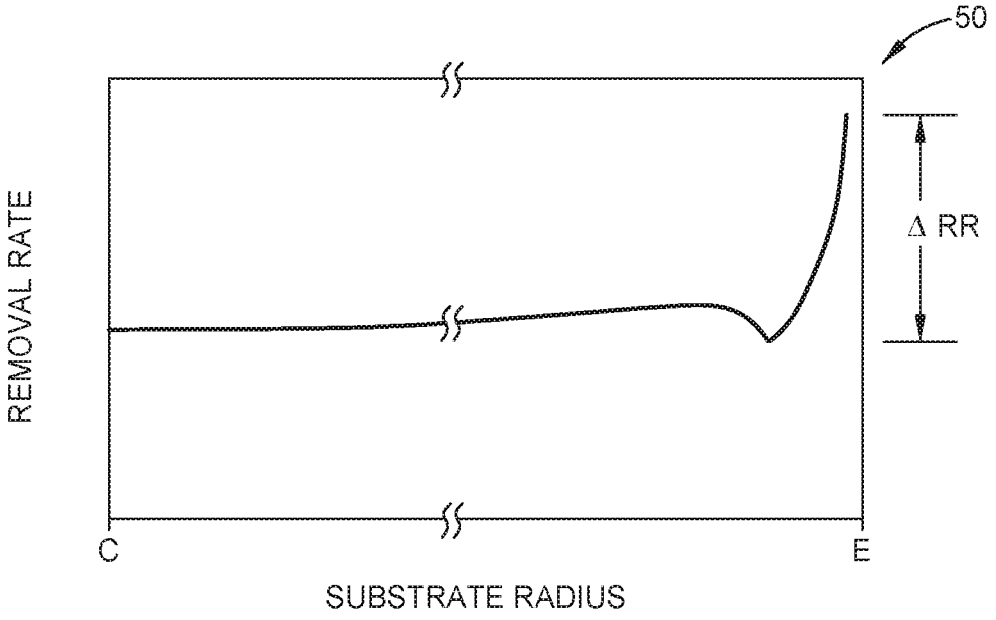
FIG. 1B is a schematic close up sectional view of a portion of a polishing interface.

An example of the pad rebound effect is schematically illustrated in FIG. 1A which shows a sectional view of a polishing interface 10 between a polishing pad 12 and a substrate 13 urged thereagainst. Here, the substrate 13 is urged against the polishing pad 12 using a substrate carrier 16 that includes a flexible membrane 24 and an annular retaining ring 26. The flexible membrane 24 exerts a downforce against the substrate 13 while the substrate carrier 16, and thus the substrate 13, and the polishing pad 12 rotate about their respective axis to provide a relative motion therebetween. The retaining ring 26 surrounds the substrate 13 and is used to contain and to position the substrate 13 under the flexible membrane 24 during polishing, i.e., to prevent the substrate 13 from slipping from the substrate carrier 16.

Generally, to contain the substrate 13 at the desired polishing interface 10, a downforce is exerted on the retaining ring 26 that is greater than, and independent from, the downforce exerted on the substrate 13. The uneven pressure distribution between the retaining ring 26 and the peripheral edge of the substrate 13 proximate thereto causes the polishing pad 12 to deform or rebound at the outer and inner edges of the retaining ring 26 as the polishing pad 12 moves therebeneath. This pad rebounding effect 15 undesirably results in a non-uniform contact pressure distribution between the substrate 13 and the polishing pad 12 at the substrate edge and points radially inward therefrom.

In addition to the pad rebound effect, CMP material rate uniformity is also determined by a complicated tribological interaction between surfaces and fluids at the polishing interface and the relative motion therebetween. For example, without intending to be bound by theory, it is generally believed that the layer of polishing fluid at the polishing interface may be relatively thin at the leading edge of the substrate (as the polishing pad rotates therebeneath) and becomes progressively thicker towards the trailing edge. This uneven polishing fluid thickness between the leading and trailing edges of the substrate may further contribute to different, e.g., non-uniform, material removal rates at the substrate edge compared to points radially inward therefrom.

Thus, embodiments herein provide for polishing systems and polishing methods designed to substantially reduce and/or eliminate the pad rebound effect at the leading and trailing polishing edges of the substrate and substantially improve the otherwise non-uniform material removal rate profiles associated therewith. Beneficially, it is further believed the polishing systems and polishing methods described herein reduce polishing fluid thickness variation across the substrate surface to improve non-uniform material removal rate profiles that may be caused thereby.

Figure 2A:
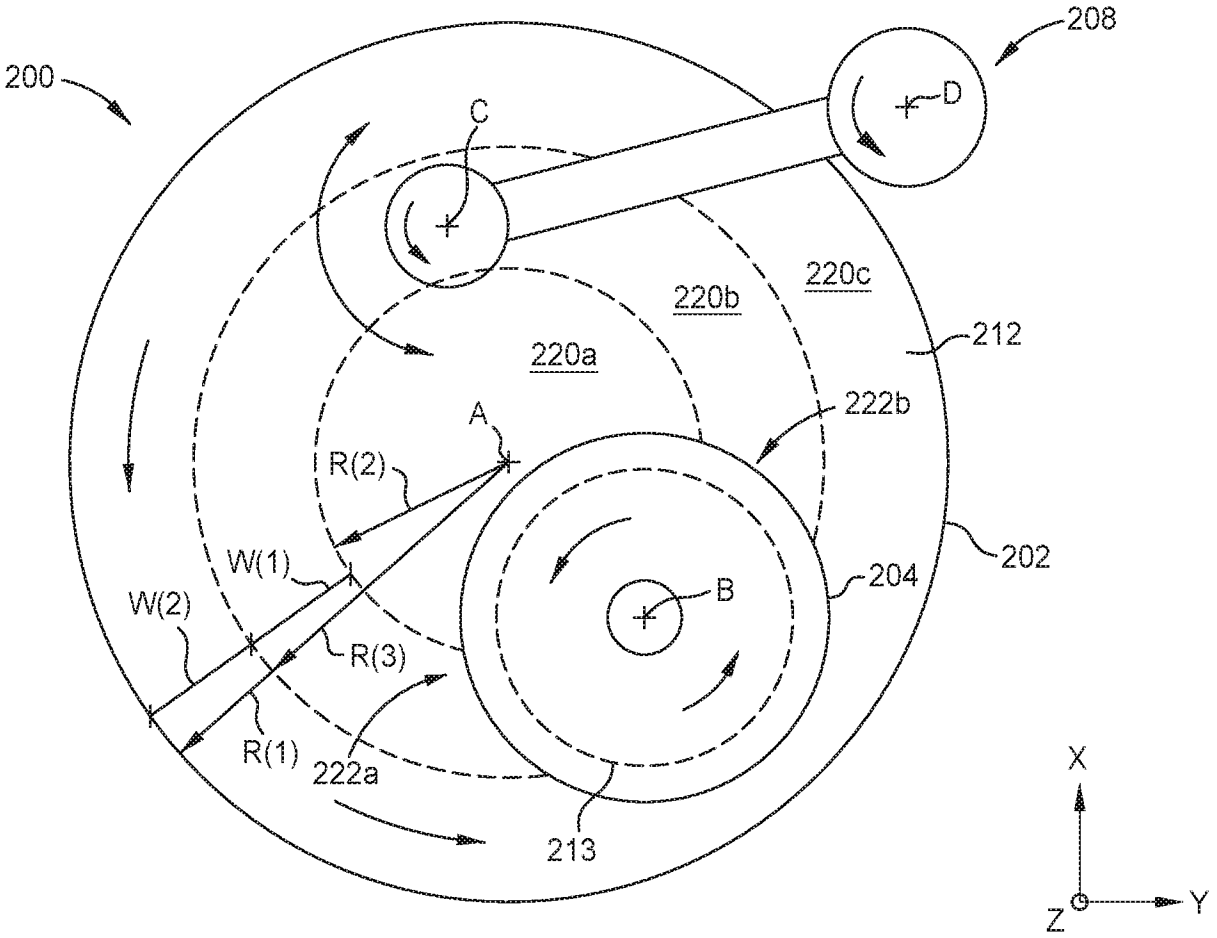
FIGS. 2A-2C schematically illustrate a polishing system, formed according to embodiments described herein.
Figure 2B:
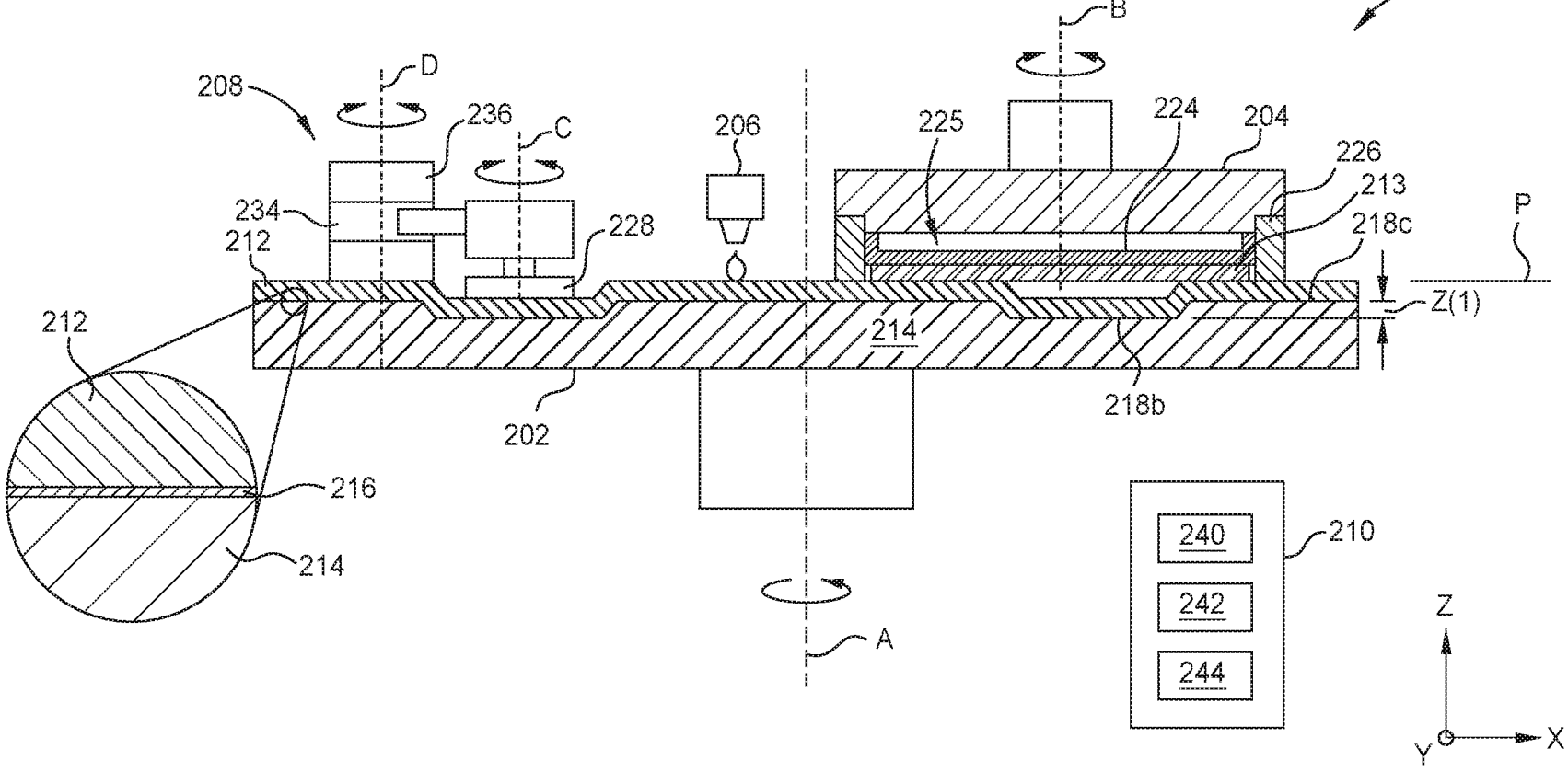
Figure 2C:
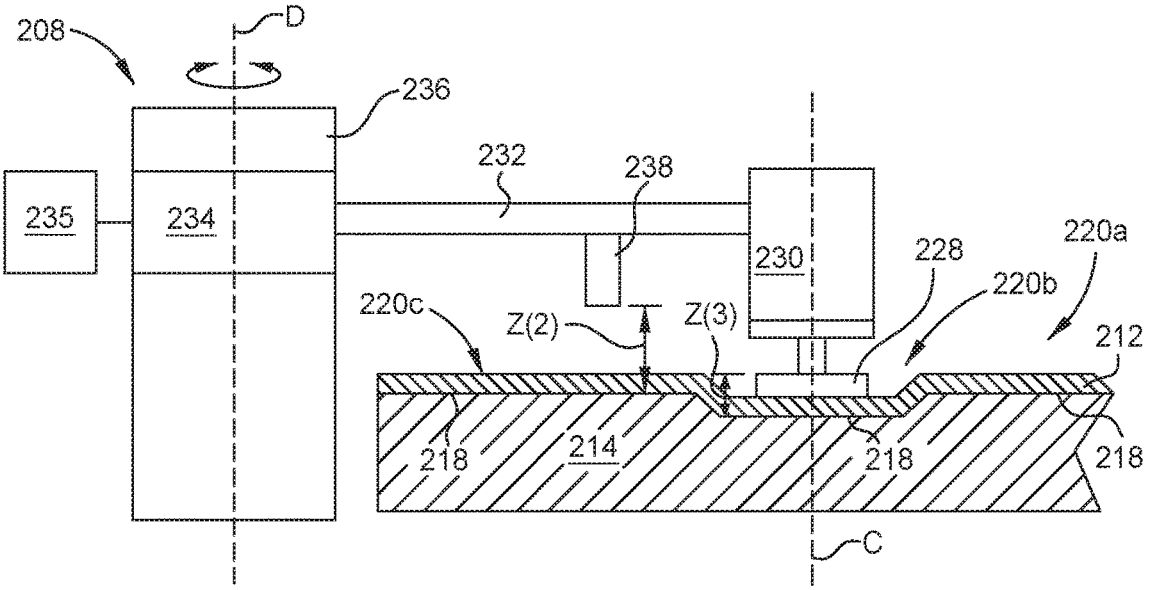

FIG. 2A is a schematic top down view of a polishing system 200, according to one embodiment, which is configured to practice the methods set forth herein. FIG. 2B is a schematic cross sectional view of the polishing system 200. FIG. 2C is a schematic side view of the pad conditioner assembly 208 and a cross sectional view of a portion of the polishing system 200. Some of the components of the polishing system 200 shown in any one of FIGS. 2A-2C are not shown in the other remaining figures in order to reduce visional clutter.

Here, the polishing system 200 includes a polishing platen 202, a substrate carrier 204, a fluid delivery arm 206, a pad conditioner assembly 208, and a system controller 210. The polishing platen 202 features cylindrical platen body 214 and a low-adhesion-material layer 216 disposed on a surface of the platen body 214 to provide a polishing pad-mounting surface 218. The platen body 214 is typically formed of a suitably rigid, light weight, and polishing fluid corrosion resistant material, such as aluminum, an aluminum alloy (e.g., 6061 Aluminum), or stainless steel. The low-adhesion-material layer 216 typically comprises a polymer material formed of one or more fluorine-containing polymer precursors or melt-processable fluoropolymers. The low-adhesion-material layer 216 desirably reduces the amount of force required to remove a polishing pad 212 from the polishing pad-mounting surface 218 once the polishing pad 212 has reached the end of its useful lifetime and further protects the metal of the platen body 214 from undesirable polishing fluid caused corrosion.

Here, the pad-mounting surface 218 comprises a plurality of concentric zones 220*a-c* formed about a platen axis A. The plurality of concentric zones 220*a-c* include a circular (when viewed from top down) or annular first zone 220*a*, an annular second zone 220*b* circumscribing the first zone 220*a*, and an annular third zone 220*c* disposed radially outward from and circumscribing the second zone 220*b*.

Here, the pad-mounting surface 218 in the second zone 220*b* is recessed from a plane P a distance Z. The plane P is defined by the pad-mounting surface 218 in the first and third zones 220*a,c* which in some embodiments, and as shown in FIG. 2B, are substantially co-planer with one another. In some embodiments, e.g., where the pad-mounting surfaces 218 in the first and third zones 220*a,c* are not co-planer with one another, the plane P may be defined by an object having a planer surface laid over and in contact with the first and third zones 220*a,c* to span the recessed second zone 220*b*. For example, in FIG. 2B the plane P is defined by a surface of a retaining ring of a substrate carrier that is positioned on the platen to span the width W of the second zone 220*b* and extend on either side thereof by distances of between about 25 mm and about 100 mm, such as between about 25 mm and about 50 mm or between about 50 mm and about 100 mm. In some embodiments, the plane P is orthogonal to the rotational axis A of the polishing platen 202.

In some embodiments, the pad-mounting surface 218 in the second zone 220*b* is recessed from the plane P by a distance Z of about 20 μm or more, about 30 μm or more, about 40 μm or more, about 50 μm or more, or about 60 μm or more. In some embodiments, the distance Z is between about 20 μm and about 500 μm, such as between about 20 μm and about 400 μm, between about 20 μm and about 300 μm, between about 20 μm and about 250 μm, or between about 20 μm and about 200 μm, such as between about 20 μm and about 150 μm. In some embodiments, the distance Z is between about 50 μm and about 500 μm, such as between about 50 μm and about 400 μm, between about 50 μm and about 400 μm, between about 50 μm and about 300 μm, between about 50 μm and about 250 μm, or between about 50 μm and about 150 μm.

In FIG. 2B, the pad-mounting surface 218 in the second zone 220*b* is substantially planer and is parallel to a plane formed by the surfaces of the first and third zones 220*a,c*. Thus, the distance Z(1) is substantially constant across a width W of the recessed pad-mounting surface 218 in the second zone 220*b*. In other embodiments, the recessed surface in the second zone 220*b* is not parallel to the plane formed by the pad-mounting surfaces of the first and third zones 220*a,c* and/or is not substantially planer across the width W thereof. For example, in some embodiments, the pad-mounting surface 218 in the second zone 220*b* may have a generally convex shape when viewed in cross section and the distance Z(1) is an average of a plurality of distances measured from the plane P to the surface in the second zone 220*b* across the width W.

In some embodiments, the width W of the recessed pad-mounting surface 218 in the second zone 220*b* is less than a diameter of the to-be-polished substrate 213, such as about 0.9× (times) the diameter D of the substrate or less, about 0.8× or less, about 0.75× or less, about 0.7× or less, about 0.65× or less, about 0.6× or less, about 0.55 or less, or about 0.5× or less than the diameter D of the to-be-polished substrate. For example, for a polishing platen 202 sized and configured for processing a 300 mm diameter substrate, the width W of the recessed pad-mounting surface 218 in the second zone 220*b* may be about 270 mm or less. In one embodiment, a polishing platen 202 sized to polish a 300 mm diameter substrate has a radius R(1) of between about 350 mm and about 400 mm, such as about 380 mm. In one embodiment, an inner radius R(2) of the second zone 220*b* is greater than about 0.15× the radius R(1), an outer radius R(3) of the second zone 220*b* is less than about 0.85× the radius R(1), and the width W of the second zone 220*b* is at least about 0.15× the radius R(1). Appropriate scaling may be used for polishing platens configured to process different sized substrates, e.g., for polishing platens configured to process 450 mm, 200 mm, or 150 mm diameter substrates.

Figure 3:
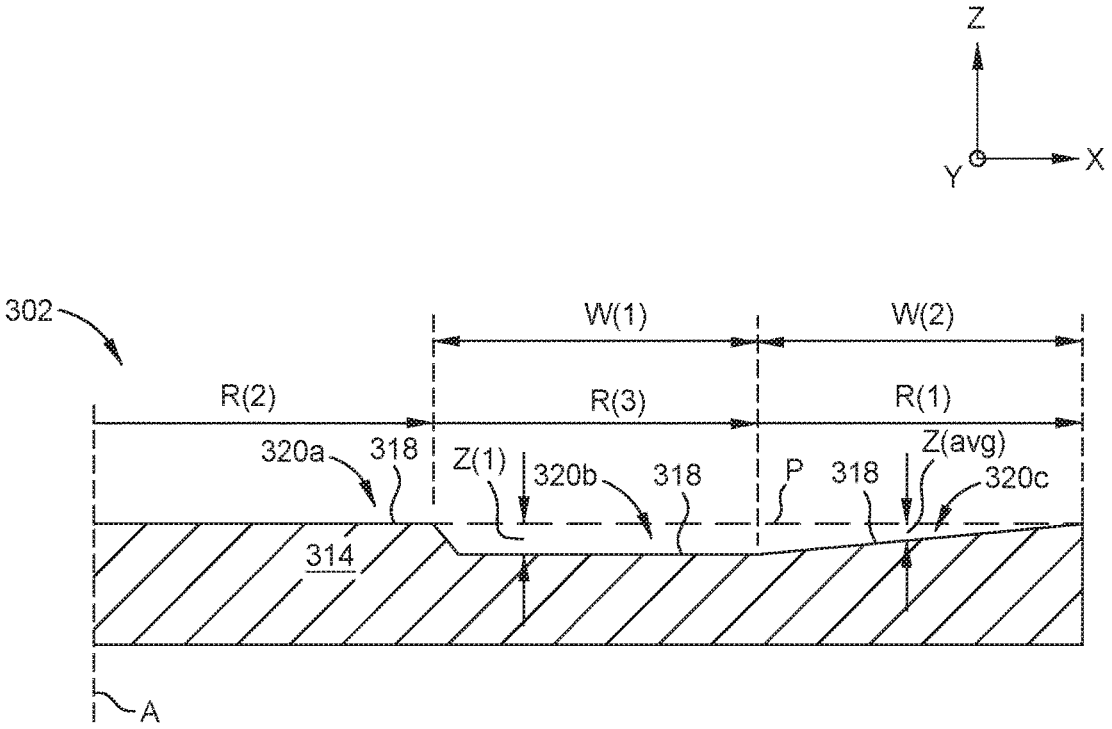
FIG. 3 is a schematic cross-sectional view of a polishing platen, according to one embodiment, which may be used in place of the polishing platen described in FIGS. 2A-2C.

In some embodiments, the pad-mounting surface 218 in the third zone 220*c* is not coplanar with the pad-mounting surface 218 in the second zone 220*b*. For example, in some embodiments the pad-mounting surface 218 in the third zone 220 is above or below (in the direction of gravity) a plane formed by the pad-mounding surface 218 in the first zone 220*a*. In some embodiments, the pad-mounting surface 218 in the third zone 220*c* is sloped such as shown and described in FIG. 3.

In some embodiments, the annular second zone 220*b* is located and sized so that, during polishing, at least a portion of the substrate 213 is disposed over and spans the recessed pad-mounting surface 218 of the second zone 220*b* and at least portions of the substrate 213 are disposed over the pad-mounting surfaces 218 of the first and third zones 220*a,c* adjacent thereto. Thus, during substrate processing, distal regions of the rotating substrate carrier 204 and a to-be-polished substrate 213 disposed therein are concurrently disposed over the pad-mounting surfaces 218 in the first zone 220 and the third zone 220*c*. Concurrently therewith, the recessed pad-mounting surface 218 of the second zone 220*b* is rotated about the platen axis A to pass under the leading and trailing edges 222*a,b* (FIG. 2A) of the rotating substrate carrier 204 and the to-be-polished substrate 213 disposed therein.

Typically, the polishing pad 212 is formed of one or more layers of polymer materials and is secured to the pad-mounting surfaces 218*a-c* using a pressure sensitive adhesive. The polymer materials used to form the polishing pad 212 may be relatively compliant or may be rigid and formed with channels or grooves in the polishing surface thereof to allow the polishing pad 212 to conform to the recessed pad-mounting surface 218 in the second zone 220*b* and the pad-mounting surfaces 218 of the first and third zones 220*a,c* adjacent thereto. Thus, the polishing surface of the polishing pad 212 in each of the zones 220*a-c* has substantially the same shapes and relative dimensions as described above for the pad-mounting surface 218 of the platen 202.

Here, the rotating substrate carrier 204 is used to exert a downforce against the substrate 213 to urge a material surface of the substrate 213 against the polishing pad 212 as the polishing pad 212 is rotated about the platen axis A. As shown, the substrate carrier 204 features a flexible membrane 224 and an annular retaining ring 226. During substrate polishing, the flexible membrane 224 exerts a downforce against a non-active (backside) surface of the substrate 213 disposed therebeneath. The retaining ring 226 surrounds the substrate 213 to prevent the substrate 213 from slipping from the substrate carrier 204 as the polishing pad 212 moves therebeneath. Typically, the substrate carrier 204 is configured to exert a downforce against the retaining ring 226 that is independent from the downforce exerted against the substrate 213. In some embodiments, the substrate carrier 204 oscillates in the radial direction of the polishing platen to, in part, reduce uneven wear of the polishing pad 212 disposed there beneath.

Typically, the substrate 213 is urged against the polishing pad 212 in the presence of the one or more polishing fluids delivered by the fluid delivery arm 206. A typical polishing fluid comprises a slurry formed of an aqueous solution having abrasive particles suspended therein. Often, the polishing fluid contains one or more chemically active constituents which are used to modify the material surface of the substrate 213 thus enabling chemical mechanical polishing thereof.

The pad conditioner assembly 208 (FIG. 2C) is used to condition the polishing pad 212 by urging a conditioning disk 228 against the surface of the polishing pad 212 before, after, or during polishing of the substrate 213. Here, the pad conditioner assembly 208 includes the conditioning disk 228, a first actuator 230 for rotating the conditioning disk 228 about an axis C, a conditioner arm 232 coupling the first actuator 230 to a second actuator 234, a rotational position sensor 235, a third actuator 236, and a displacement sensor 238. The second actuator 234 is used to swing the conditioner arm 232 about an axis D to thus sweep the rotating conditioning disk 228 back and forth between an inner radius and an outer radius of the polishing pad 212. The position sensor 235 is coupled the second actuator 234 and is used to determine the angular position of the conditioner arm 232, which in turn may be used to determine the radial location of the conditioning disk 228 on the polishing pad 212 as the conditioning disk 228 is swept thereover. The third actuator 236 is used to exert a downforce on the conditioning disk 228 as it is urged against the polishing pad 212. Here, the third actuator 236 is coupled to an end of the arm 232 at a location proximate to the second actuator 234 and distal from the conditioning disk 228.

Typically, the conditioning disk 228 is coupled to the first actuator 230 using a gimbal which allows the conditioning disk 228 to maintain a parallel relationship with the surface of the polishing pad 212 as the conditioning disk 228 is urged thereagainst. Here, the conditioning disk 228 comprises a fixed abrasive conditioning surface, e.g., diamonds embedded in a metal alloy, and is used to abrade and rejuvenate the surface of polishing pad 212, and to remove polish byproducts or other debris therefrom. Typically, the conditioning disk 228 has a diameter between about 80 mm and about 130 mm, such as between about 90 mm and about 120 mm, or for example, about 108 mm (4.25 inches). In some embodiments, the diameter of the conditioning disk 228 is less than the width W of the second zone 220*b* so that the conditioning disk 228 may maintain contact with surface of the polishing pad 212 during conditioning thereof in the second zone 220*b*.

Here, the displacement sensor 238 is an inductive sensor which measures eddy currents to determine a distance Z(2) between an end of the sensor 238 to the metallic surface of the platen body 214 disposed therebeneath. The displacement sensor 238 and the position sensor 235 are used in combination to determine the recessed distance Z(3) of the surface of the polishing pad 212 in the second zone 220*b* from the surfaces of the polishing pad 212 in the first and third zones 220*a,c* adjacent thereto.

In some embodiments, the pad conditioner assembly 208 is used to maintain the recessed relationship of the surface of the polishing pad 212 in the second zone 220*b* relative to the surfaces of the polishing pad 212 in the first and third zones 220*a,c* adjacent thereto. In those embodiments, the system controller 210 may be used to change a dwell time of the conditioning disk 228 and/or a downforce on the conditioning disk 228 in the second zone 220*b*. As used herein dwell time refers to an average duration of time a conditioning disk 228 spends at a radial location as the conditioning disk 228 is swept from an inner radius to an outer radius of the polishing pad 212 as the platen 202 rotates to move the polishing pad 212 there beneath. For example, the conditioning dwell time per $cm^2$ of polishing pad surface area in the second zone 220*b* may be increased or decreased relative to the conditioning dwell time per $cm^2$ of polishing pad surface area in one or both of the first and/or third zone 220*a,c* adjacent thereto.

Here, operation of the polishing system 200, including operation of the pad-conditioning assembly 208, is facilitated by the system controller 210 (FIG. 2A). The system controller 210 includes a programmable central processing unit (CPU 240) which is operable with a memory 242 (e.g., non-volatile memory) and support circuits 244. For example, in some embodiments the CPU 240 is one of any form of general purpose computer processor used in an industrial setting, such as a programmable logic controller (PLC), for controlling various polishing system component and sub-processors. The memory 242, coupled to the CPU 240, is non-transitory and is typically one or more of readily available memory such as random access memory (RAM), read only memory (ROM), floppy disk drive, hard disk, or any other form of digital storage, local or remote. The support circuits 244 are conventionally coupled to the CPU 240 and comprise cache, clock circuits, input/output subsystems, power supplies, and the like, and combinations thereof coupled to the various components the polishing system 200, to facilitate control of a substrate polishing process.

Herein, the memory 242 is in the form of a computer-readable storage media containing instructions (e.g., non-volatile memory), that when executed by the CPU 240, facilitates the operation of the polishing system 200. Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. The instructions in the memory 242 are in the form of a program product such as a program that implements the methods of the present disclosure (e.g., middleware application, equipment software application etc.). In some embodiments, the disclosure may be implemented as a program product stored on a non-transitory computer-readable storage media for use with a computer system. Thus, the program(s) of the program product define functions of the embodiments (including the methods described herein).

FIG. 3A is a schematic cross-sectional view of a portion of a polishing platen 302, which may be used in place of the polishing platen 202 in FIGS. 2A-2B. Here, the platen 302 has a pad-mounting surface 318 which comprises a plurality of concentric zones 320*a-c* formed about the platen axis A. The plurality of concentric zones 320*a-c* include a circular (when viewed from top down) or annular first zone 320*a*, an annular second zone 320*b* circumscribing the first zone 320*a*, and an annular third zone 320*c* disposed radially outward from and circumscribing the second zone 320*b*. The platen 302 may include any one or combination of the features of the platen 202 described above.

Here, the pad-mounting surface 318 in the third zone 320*c* slopes upwardly from the intersection with the pad mounting surface 318 in the second zone 320*b* to a circumferential edge of the platen 302 or a location proximate thereto. For example, for a platen body 314 sized for a 300 mm diameter substrate, the annular third zone 320*b* may have an inner radius of between about 250 mm and about 355 mm, such as between about 280 and about 330 mm. Typically, in those embodiments, the pad-mounting surface 318 in the third zone 320*c* is recessed from the plane P by an average distance Z(avg) which is about ⅔× or less than the recess Z(1) of the pad-mounting surface in the second zone 320*b*, such as about ½× or less. Here, the plane P is defined by at least portions of the pad-mounting surfaces of the first and third zones and is disposed orthogonal to the rotational axis A.

Figure 4:
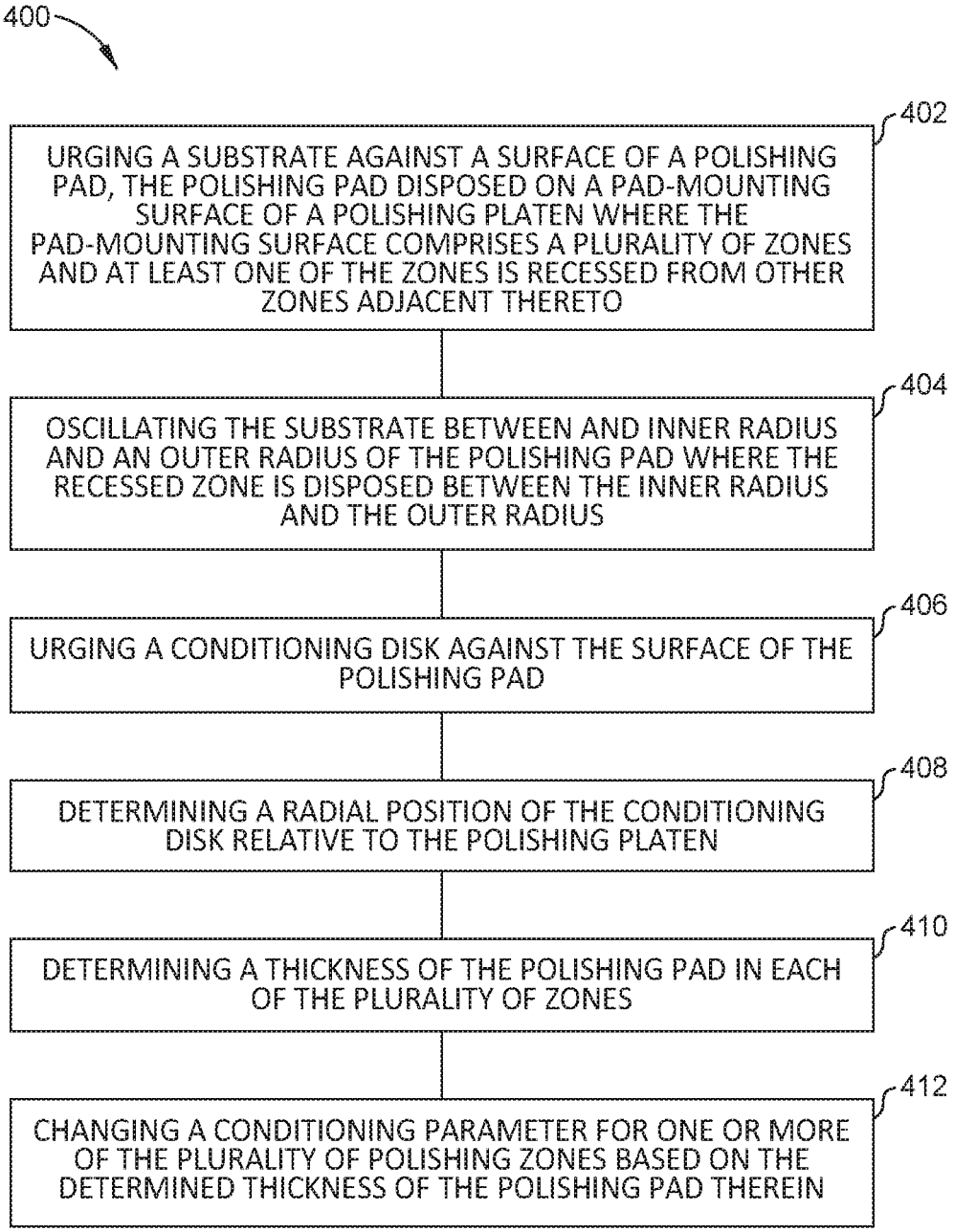
FIG. 4 is a diagram illustrating a method of polishing a substrate, according to one embodiment.

FIG. 4 is a diagram illustrating a method 400 of polishing a substrate, according to one embodiment, that may be performed using the polishing system 200 described in FIGS. 2A-2C. At activity 402 method 400 includes urging a substrate against a surface of a polishing pad. Here, the polishing pad is disposed on, and is secured to, a pad-mounting surface of a polishing platen. The pad-mounting surface includes a plurality of polishing zones, such as a first zone having a circular or annular shape, a second zone disposed adjacent to and circumscribing the first zone, and a third zone disposed adjacent to and circumscribing the second zone. Here, a surface in the second zone is recessed from surfaces of the first and third zones adjacent thereto and a width of the second zone is less than a diameter of the substrate. At activity 404, the method optionally includes oscillating the substrate between and inner radius and an outer radius of the polishing pad.

In some embodiments, the method 400 further includes urging a conditioning disk the surface of the polishing pad at activity 406, determining a radial position of the conditioning disk relative to the polishing platen at activity 408, and using a measurement from a displacement sensor and the determined radial position of the conditioning disk to determine a thickness of the polishing pad in each of the plurality of polishing zones at activity 410. In some embodiments, the method 400 further includes changing a conditioning dwell time or conditioning downforce in one or more of the plurality of polishing zones based on the determined thickness of the polishing pad therein at activity 412.

Beneficially, the method 400 may be used to substantially reduce the pad rebound effect at the leading and trailing edges of the polishing interface and to reduce uneven polishing fluid thickness distribution thereacross. Thus the method 400 may be used to substantially eliminate or reduce undesirable "fast edge" or "slow edge" material removal rate profiles.

While the foregoing is directed to embodiments of the present disclosure, other and further embodiments of the disclosure may be devised without departing from the basic scope thereof, and the scope thereof is determined by the claims that follow.

The invention claimed is:

1. A polishing system, comprising:

a substrate carrier comprising an annular retaining ring configured to surround a to-be-processed substrate during a polishing process; and a rotatable polishing platen comprising a cylindrical metal body having a pad-mounting surface, wherein the pad-mounting surface comprises a plurality of polishing zones which include a first zone having a circular or annular shape, a second zone circumscribing the first zone, and a third zone circumscribing the second zone, at least portions of the pad-mounting surface in the first and third zones define a plane, the plane is orthogonal to a rotational axis of the polishing platen, the pad-mounting surface in the second zone is recessed from the plane, a width of the second zone is less than an outer diameter of the annular retaining ring, and the pad-mounting surface in the third zone slopes upwardly from the pad-mounting surface in the second zone to intersect a circumferential edge of the platen at an acute angle.

2. The polishing system of claim 1, wherein at least a portion of the pad mounting surface in the second zone is recessed from the plane by a distance of about 20 μm or more.

3. The polishing system of claim 1, further comprising a pad conditioner assembly comprising a conditioner arm for sweeping a conditioning disk across a surface of a polishing pad disposed on the polishing platen, wherein the conditioning disk has a diameter that is less than the width of the second zone, wherein the pad conditioner assembly further comprises a sensor coupled to the conditioner arm and the sensor is configured to determine a distance between the conditioning arm and a surface of the polishing platen disposed there below.

4. The polishing system of claim 3, further comprising a non-transitory computer readable medium having instructions stored thereon for performing a method of processing a substrate when executed by a processor, the method comprising:

urging the substrate against the surface of the polishing pad, the polishing pad disposed on the pad-mounting surface of the polishing platen;

urging the conditioning disk against the surface of the polishing pad;

determining a radial position of the conditioning disk relative to the polishing platen;

determining, using the sensor and the radial position of the conditioning disk, a thickness of the polishing pad in each of the plurality of zones; and changing one or both of a conditioning dwell time or conditioning downforce in one or more of the plurality of polishing zones based on the determined thickness of the polishing pad therein.

5. The polishing system of claim 4, wherein the method comprises changing the conditioning dwell time so that the conditioning dwell time per $cm^2$ of polishing pad surface area in the second zone is greater than the conditioning dwell time per $cm^2$ of polishing pad surface area in either of the first or third zone.

6. A method of polishing a substrate, comprising:

urging, using a substrate carrier, a substrate against a surface of a polishing pad, the polishing pad disposed on a pad-mounting surface of a polishing platen, wherein the pad-mounting surface comprises a plurality of polishing zones which include a first zone having a circular or annular shape, a second zone circumscribing the first zone, and a third zone circumscribing the second zone, at least portions of the pad-mounting surface of the first and third zones define a plane, the pad-mounting surface in the third zone slopes upwardly from the pad-mounting surface in the second zone to intersect a circumferential edge of the platen at an acute angle, the plane is orthogonal to a rotational axis of the polishing platen, and the pad-mounting surface in the second zone is recessed from the plane.

7. The method of claim 6, further comprising:

urging a conditioning disk against the surface of the polishing pad;

determining a radial position of the conditioning disk relative to the polishing platen;

determining, using a sensor and the radial position of the conditioning disk, a thickness of the polishing pad in each of the plurality of polishing zones; and changing one or both of a conditioning dwell time or conditioning downforce in one or more of the plurality of polishing zones based on the determined thickness of the polishing pad therein.

8. The method of claim 7, wherein the conditioning disk has a diameter that is less than a width of the second zone.

9. The method of claim 8, wherein the conditioning disk is urged against the polishing pad using a pad conditioner assembly, the pad conditioner assembly comprising a conditioner arm for sweeping the conditioning disk across the surface of the polishing pad, wherein the sensor is coupled to the conditioning arm, and the sensor is configured to determine a distance between the conditioning arm and a surface of the polishing platen disposed there below.

10. The method of claim 9, wherein the conditioning dwell time per $cm^2$ of polishing pad surface area in the second zone is greater than the conditioning dwell time per $cm^2$ of polishing pad surface area in either of the first or third zone.

11. The method of claim 6, wherein the substrate carrier comprises an annular retaining ring which surrounds the substrate, a width of the second zone is less than an outer diameter of the annular retaining ring.

12. The method of claim 11, wherein at least a portion of the pad mounting surface in the second zone is recessed from the plane by a distance of about 20 μm or more.

13. A polishing platen, comprising:

a cylindrical metal body having a pad-mounting surface, wherein the pad-mounting surface comprises a plurality of polishing zones which include a first zone having a circular or annular shape, a second zone circumscribing the first zone, and a third zone circumscribing the second zone, the pad-mounting surface in the third zone slopes upwardly from the pad-mounting surface in the second zone to intersect a circumferential edge of the platen at an acute angle, at least portions of the pad-mounting surface of the first and third zones define a plane, the plane is orthogonal to a rotational axis of the polishing platen, and the pad-mounting surface in the second zone is recessed from the plane.

14. The polishing platen of claim 13, wherein at least a portion of the pad mounting surface in the second zone is recessed from the plane by a distance of about 20 μm or more.

15. The polishing platen of claim 14, wherein the pad-mounting surface comprises a fluorine-containing polymer material coating and the recessed surface of the second zone is at least partially formed in the polymer material.

16. The polishing platen of claim 14, wherein the recessed surface of the second zone is at least partially formed in the cylindrical metal body and the pad-mounting surface comprises a fluorine-containing polymer material coating disposed on the cylindrical metal body.

17. The polishing platen of claim 13, wherein an inner radius of the second zone is greater than about 0.15× the radius of the pad-mounting surface, an outer radius of the second zone is less than about 0.85× the radius of the pad mounting surface, and a width of the second zone is at least about 0.15× the radius of the pad-mounting surface.

* * * * *